US007150235B1

(12) United States Patent
Mikhail

(10) Patent No.: US 7,150,235 B1
(45) Date of Patent: Dec. 19, 2006

(54) ANTI-ARMOR MULTIPURPOSE AND CHEMICAL ENERGY PROJECTILES

(75) Inventor: Ameer G. Mikhail, Bel Air, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 289 days.

(21) Appl. No.: 10/798,954

(22) Filed: Mar. 12, 2004

(51) Int. Cl.
*F42B 10/06* (2006.01)
*F42B 12/06* (2006.01)
*F42B 12/16* (2006.01)

(52) U.S. Cl. ..... 102/518; 102/521

(58) Field of Classification Search ..... 102/518, 102/476, 521, 522, 523, 438, 475, 520, 703; 244/3.24, 3.25, 3.26, 3.3
See application file for complete search history.

(56) References Cited

U.S. PATENT DOCUMENTS

| | | | | |
|---|---|---|---|---|
| 4,102,271 A | | 7/1978 | Bethmann | 102/521 |
| 4,497,253 A | | 2/1985 | Sabranski | 102/476 |
| 4,706,569 A | * | 11/1987 | Wallow et al. | 102/518 |
| 5,191,169 A | | 3/1993 | Hu | 102/476 |
| 5,744,746 A | | 4/1998 | Tripptrap et al. | 102/476 |
| 5,892,217 A | * | 4/1999 | Pollin | 244/3.3 |
| 6,109,185 A | | 8/2000 | Mikhail | 102/476 |
| 6,492,632 B1 | * | 12/2002 | Pollin | 244/3.3 |
| 6,598,535 B1 | * | 7/2003 | Kielsmeier et al. | 102/518 |
| 6,843,179 B1 | * | 1/2005 | Hunn et al. | 102/519 |
| 7,013,811 B1 | * | 3/2006 | Sebasto et al. | 102/521 |
| 7,036,434 B1 | * | 5/2006 | Vo et al. | 102/522 |

FOREIGN PATENT DOCUMENTS

| | | | |
|---|---|---|---|
| DE | 3229220 C1 | * | 1/1992 |
| GB | 2257238 A | * | 1/1993 |

* cited by examiner

*Primary Examiner*—Michael J. Carone
*Assistant Examiner*—James S. Bergin
(74) *Attorney, Agent, or Firm*—William V. Adams; William Randolph

(57) ABSTRACT

An anti-armor projectile has a tail fin boom having an inner hollow area. A warhead made of high density materials is disposed in the hollow area to serve as a kinetic-energy penetrator that is released upon impact to increase the lethality of the anti-armor projectile.

20 Claims, 5 Drawing Sheets

ANTI-ARMOR MULTIPURPOSE AND CHEMICAL ENERGY PROJECTILES

GOVERNMENT INTEREST

The invention described herein may be manufactured and used by or for the Government of the United States of America for government purposes without the payment of any royalties therefor.

BACKGROUND OF THE INVENTION

1. Field of the Invention

This invention relates to an armor-penetrating tandem-projectile.

2. Description of the Related Art

Certain types of chemical energy (CE) warheads are formed by cone-shaped metallic liners which are later transformed into a metallic liquid jet by an explosive shaping charge carried on board the projectile. The CE warhead must be activated very near the target (about 1–2 meters) so that the formed metallic jet does not break up. Also, a spacer/spike in front of the liner provides a very short time delay needed to form the jet, when an impact fuse is mounted on the tip of that spacer spike. Alternatively, a proximity fuse may be used instead of the impact fuse if the intended target is moving (as in helicopters) or is relatively distant (4,000–5,000 meters) and a direct impact is less likely to happen. This last scenario is the actual incentive for the concept of multipurpose (MP) projectiles.

Anti-armor kinetic energy (KE) projectiles are long rods launched at high speed, causing damage due to their kinetic energy (mass and speed). Therefore, they are usually made of high density materials to increase the mass for a given volume.

U.S. Pat. No. 6,109,185 includes several tandem warhead configurations including KE-CE, CE-KE, KE-KE, or CE-CE arrangements. U.S. Pat. No. 4,102,271 discloses a KE-CE combination. U.S. Pat. No. 5,191,169 shows multiple EFP (explosively formed projectile) configurations. U.S. Pat. No. 5,744,746 shows a CE-CE tandem configuration. U.S. Pat. No. 4,497,253 shows a KE-KE configuration.

FIG. 1 illustrates a conventional multipurpose (MP) projectile 10, with its typical main components. Projectile 10 includes a metallic conical liner 12 which transforms into a liquid metallic jet after detonation. A conical nose windshield 14 reduces the drag and also provides a stand-off distance between the point of impact and the conical liner 12. A tail fin boom 16 is used to mount a stabilizing fin set piece 18. The tail fin boom 16 is usually screwed to the main body through threads 20 and to the fin set piece 18 through another set of threads 22.

FIG. 2 shows a conventional chemical energy (CE) projectile 30 also known as a HEAT (High Explosive Anti-Tank) projectile. It also has a metallic conical liner 32 and a front stand-off spacer 34, usually referred to as "the spike." The solid tail fin boom 36 is also used to mount the stabilizing fin set piece 38. The tail fin boom 36 is attached to the main body of the projectile through threads 40, and a fin set piece 38 is attached to the tail fin boom 36 through another set of threads 42. In both FIGS. 1 and 2, the boom is usually solid (no internal holes or cavities) and only serves to carry the stabilizing fins.

FIG. 3 illustrates details of tail fin boom 50 of the MP projectile of FIG. 1, showing the threads 52 needed to connect to the main body of the projectile, as well as threads 54 needed to attach the tail set fins 56, which are part of the fin piece 57, to the tail fin boom.

SUMMARY OF THE INVENTION

The present invention is directed to a tandem warhead, in which the tail fin boom is provided with an added warhead. The forward-momentum energy released through impact is used as a mechanism for the added warhead release. The present invention includes a restraining mechanism to restrain the added warhead from spin slipping with respect to the spinning carrier projectile and to restrain the added warhead from backward movement at launch (set back), by resting the rod rear-end on an impact load-carrying end-piece. The restraining mechanism alters upon impact of the projectile to enable forward release of the added warhead through the destruction of the threads on a front screwing nut.

More particularly, the present invention increases the lethality of MP and CE warhead projectiles, by utilizing and converting the tail fin boom into a tube carrying an added high-density KE penetrator rod warhead. The penetrator rod is positioned to impact the target after the detonation of the front main CE or MP warhead. The release mechanism for the added KE penetrator rod is the forward momentum energy released by the stoppage of the main carrier projectile upon impact with the target. Upon impact, the added penetrator slips forward, following into the hole created by the MP/CE liquid metal jet, imparting more kinetic energy and causing deeper penetration damage to the target.

The present invention can be applied to both categories of projectiles (MP projectiles and fin-stabilized CE projectiles) and can be applied as well to the existing stock of both 120 mm and 105 mm CE and MP munitions. To retrofit the existing stock, the tail boom must be modified, and the fin unit, usually screwed onto the tail fin boom, must be modified to account for the heavier weight of the added KE warhead.

DETAILED DESCRIPTION OF THE PREFERRED EMBODIMENTS

Figure 1:
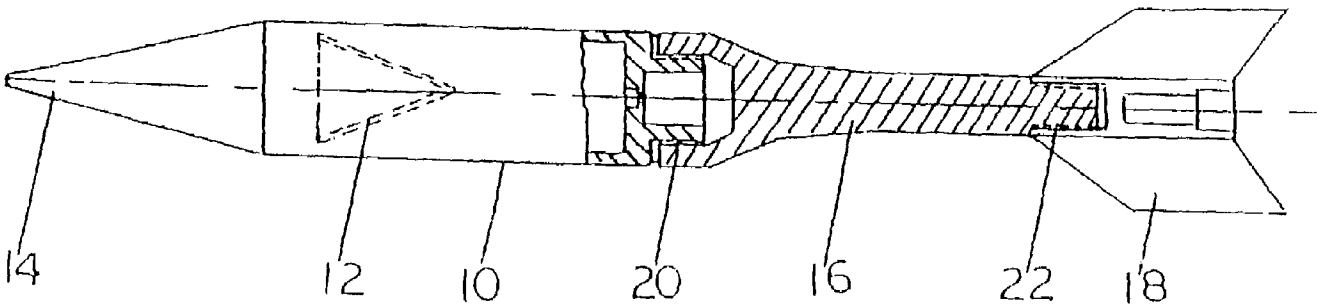
FIG. 1 PRIOR ART
FIG. 1 is a cross-sectional view of a conventional multipurpose projectile configuration.
Figure 2:
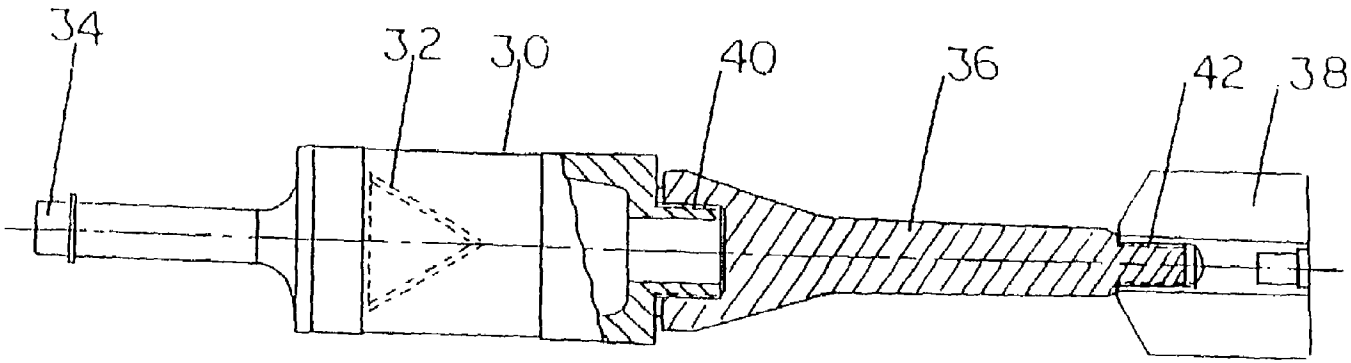
FIG. 2 PRIOR ART
FIG. 2 is a cross-sectional view of a conventional chemical energy warhead projectile.
Figure 3:
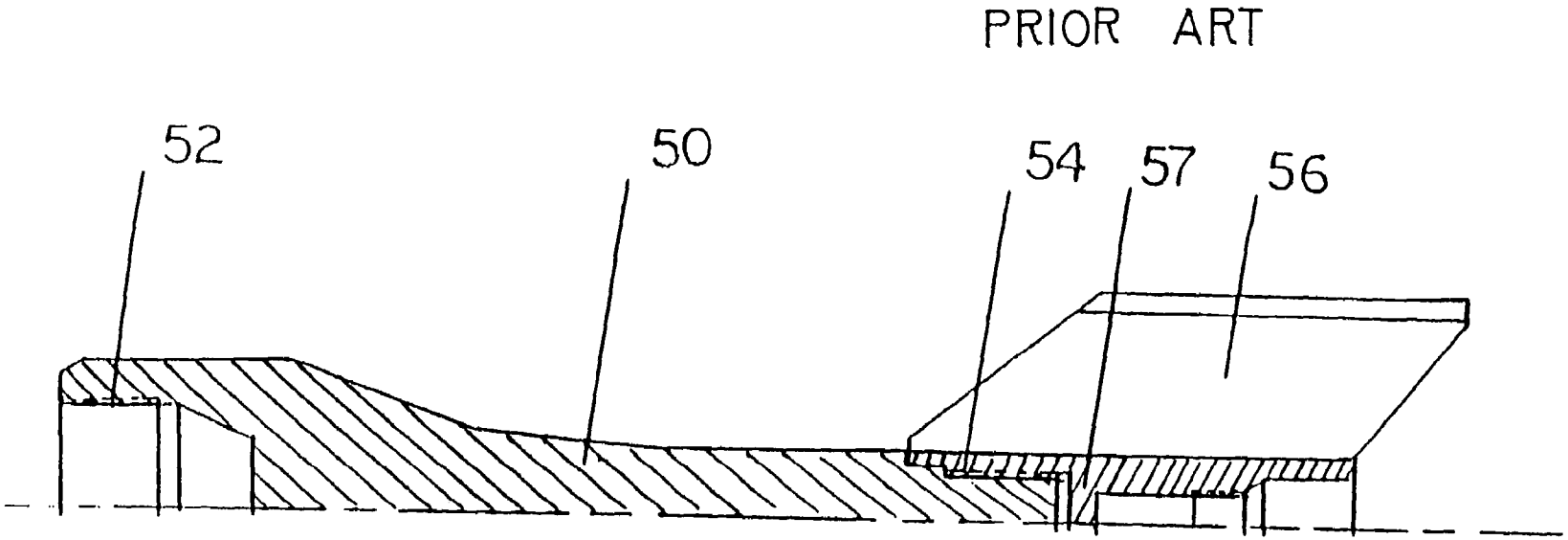
FIG. 3 PRIOR ART
FIG. 3 is a cross-sectional view of a conventional tail fin boom of a multipurpose anti-armor projectile.
Figure 4:
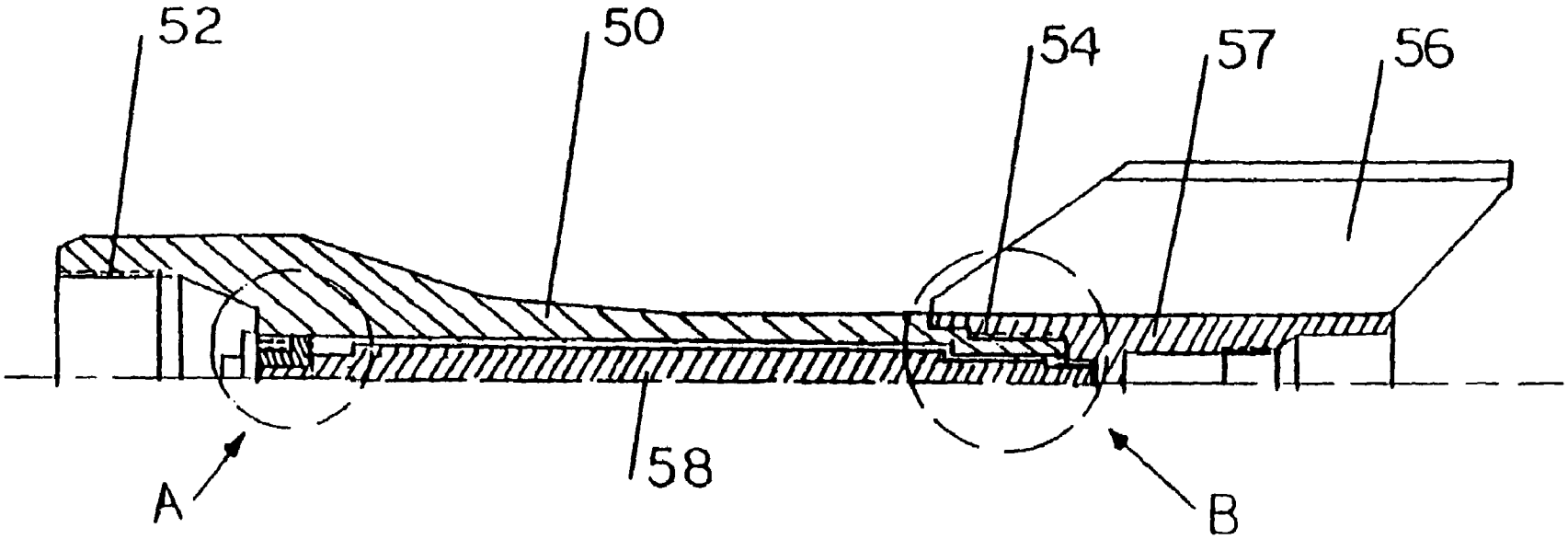
FIG. 4 is a cross-sectional view of an added KE penetrator rod warhead in a modified tail fin boom according to the present invention.
Figure 5:
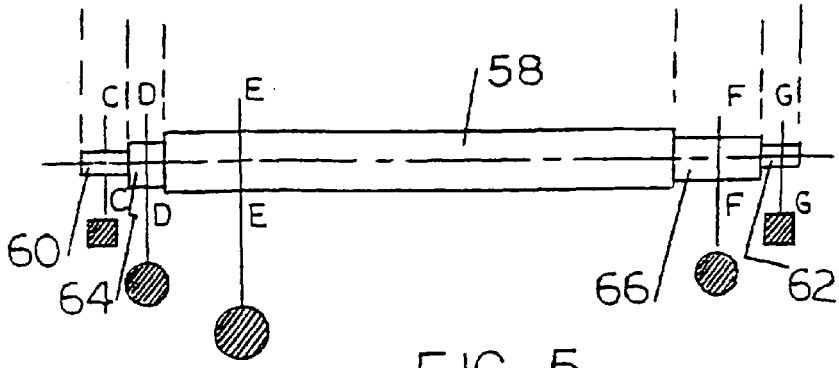
FIG. 5 shows details of the added KE penetrator rod warhead shown in FIG. 4.

FIG. 4 shows an anti-armor projectile according to the present invention. The projectile includes a tail fin boom 50, front threads 52, rear threads 54, fins 56, and a fin set piece 57. The tail fin boom has a fin-end (first end), and a main body end (second end). An added kinetic energy rod warhead 58 is housed in a long central hole provided in the tail fin boom itself. This added rod warhead is shown in FIG. 5. The rod warhead 58 may be of circular cross section as given by section E—E, among other possible shapes. The rod warhead is usually made of high-density material (e.g., tungsten or depleted uranium). The embodiment of FIG. 5 shows the rod with stepped-down ends 60, 62, 64, and 66. Reduced size ends are needed to arrange for the support, resting, and attachment of the added warhead to the main carrier body of the projectile. The front-step 60 and rear-step 62 are non-circular as shown by sections C—C and G—G of FIG. 5. The steps 64 and 66 are depicted as being of circular cross section by sections D—D and F—F of FIG. 5; however, they can also be of any other cross sectional shape.

The present invention provides novel features to enable the functioning of the added warhead. First, the added warhead should not spin relative to the spinning carrier projectile. Such relative spin may cause in-flight dynamic instability for the carrier projectile or cause inaccuracy in target hitting. Second, the added warhead should be supported at its rear end (toward the fins) such that the support part can withstand the inertia force due to the large launch acceleration (set-back force). Third, the added warhead must be restrained from relative axial movement (relative to the main carrier projectile); however, it also must be able to be released freely forward, when the carrier projectile movement is suddenly halted at impact with a target. The present invention provides for these three considerations to be satisfied in the warhead and the carrier projectile. These features are described next for the preferred embodiment.

Figure 6:
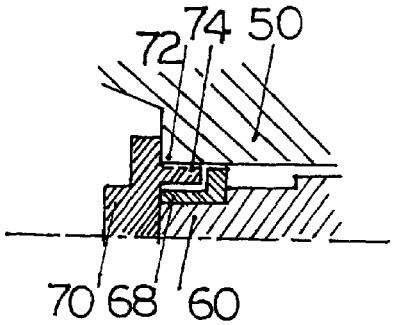
FIG. 6 is a cross-sectional view of detail area (A) of FIG. 4, showing the front support design for the added KE penetrator rod warhead.
Figure 7:
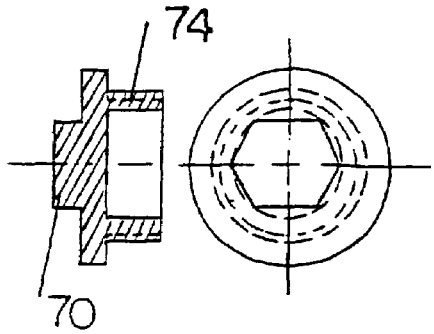
FIG. 7 is a cross-sectional view of the front screwing nut 70 of FIG. 6.
Figure 8:
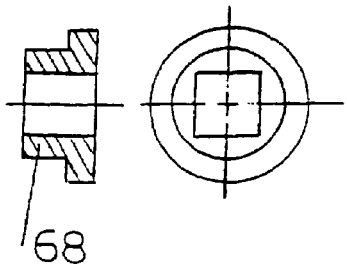
FIG. 8 is a cross-sectional view of an adapter piece 68, of FIG. 6.

FIG. 6 depicts the front end 60 of the rod which enables a resting function and the forward release arrangement. The front end 60 is of non-circular cross section, a square section in this embodiment, for example. This square end 60 rests inside a matching shaped hole of a small sleeve piece 68. This sleeve piece 68 is connected to the carrier projectile through a screwing nut 70 which is screwed to the inner body of the carrying projectile 72 through restraining threads 74. The screwing nut 70 may have a hexagonal head to allow for the assembly and tightening of the warhead assembly to allow substantially no relative motion between the main carrier projectile and the newly added warhead rod. The threads on the screwing nut 70 (i.e., the restraining threads 74) are precalculated to fail (by being sheared off) by the forward momentum force of the rod warhead 58 at the moment of impact with the target. Details of both the tightening nut 70 and the adjacent small sleeve piece 68 are shown in FIGS. 7 and 8 respectively.

Figure 9:
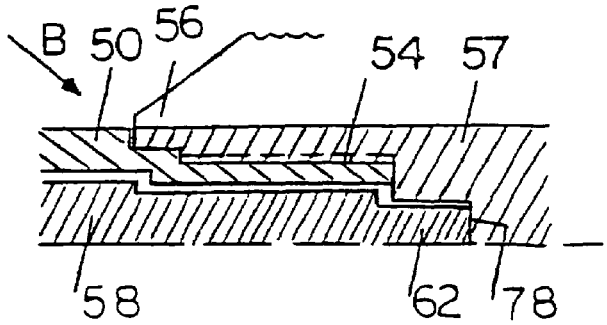
FIG. 9 is a cross-sectional view of detail area (B) of FIG. 4, showing the rear support design for the added KE penetrator rod warhead.

The rod rear end 62 is also of non-circular cross section (square in the present embodiment of FIG. 5) to be matched in a corresponding non-circular recess in the fin set piece 57, as shown in FIG. 9. The end of the rear non-circular end 62 must rest on a surface 78 of the fin set piece 57, to withstand the rod acceleration inertia force load generated at launch.

Figure 10:
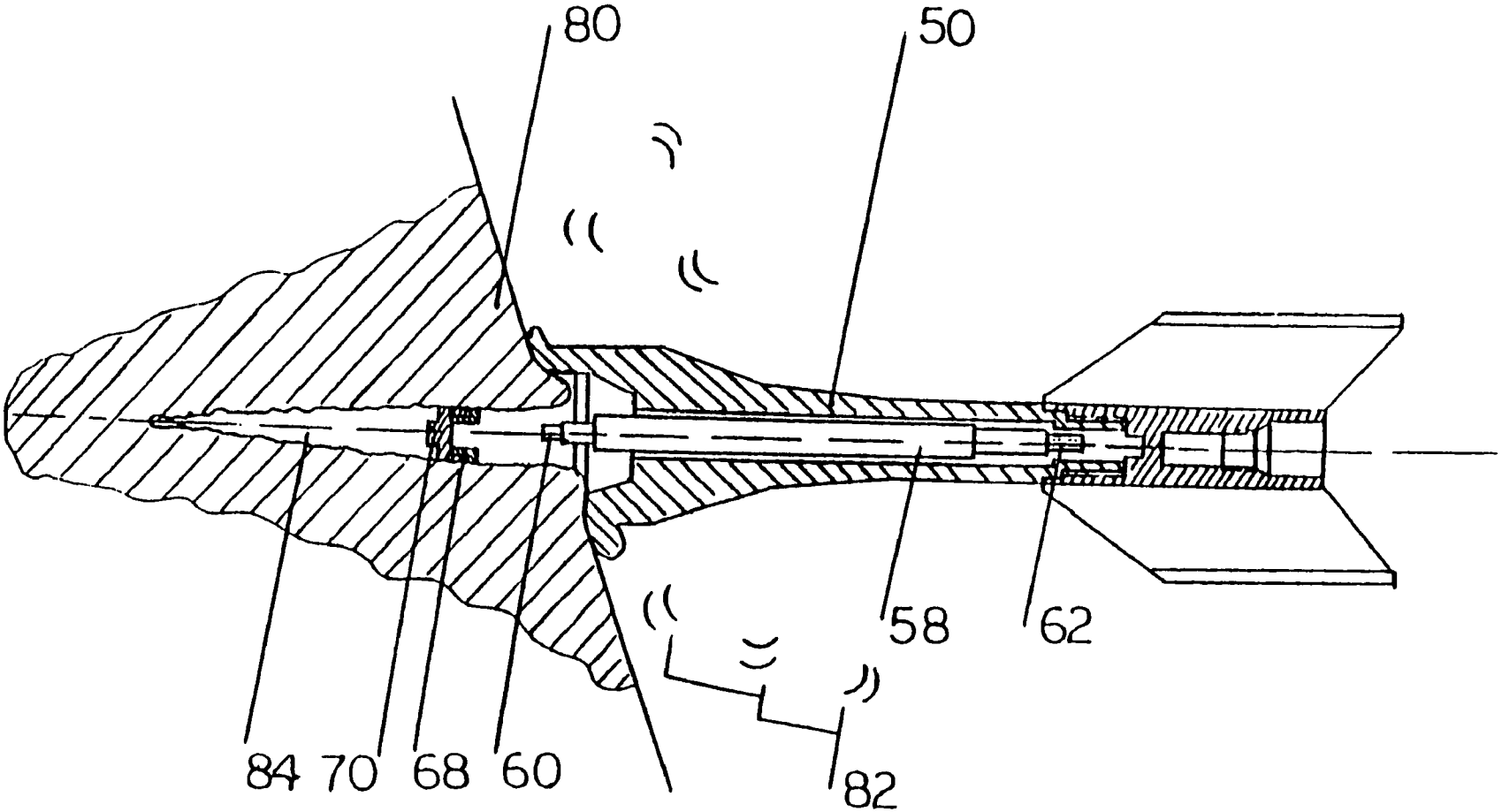
FIG. 10 is a cross-sectional view of the release of the added KE penetrator rod warhead and the carrier projectile upon impact with a target.

FIG. 10 shows the operation of the added rod warhead. When a MP projectile, using either an impact fuse or a proximity fuse, impacts a target surface 80, the rear part of the projectile represented by the tail fin boom 50 proceeds forward toward the target surface 80. The inertia force of the rod warhead 58 will push forward the short sleeve piece 68 which will in turn push forward the tightening nut 70. The threads on the tightening nut 70 will shear off from the tail fin boom 50 and both pieces will move forward, followed by the rod warhead 58 which has lost its restraining obstacles. The rod warhead 58 will move forward inside the just created hole 84 created by the main CE warhead (for the impact-fuse scenario), or hit the solid surface 80 causing a new hole and added damage (in the proximity-fuse scenario), where the debris 82 is shown. In either case, more damage is done to the target 80 than if the boom had no added rod warhead 58.

The above-described embodiments illustrate various non-limiting arrangements of the present invention. The scope of the present invention is limited only by the breadth of the attached claims. Every aspect of the design or fitting of parts, threads, and the like can be easily changed in location, size, or type, without departing from the basic teachings of this invention. Varying rod warhead size, length, mass, shape, or other parameters to obtain enhanced lethality performance over the given configuration is within the scope of this invention. Changes by those skilled in the art to rearrange or improve this design in terms of easier manufacturability, cost, material choice, or lethality performance fall within the scope of the present invention.

What is claimed is:

1. An anti-armor projectile comprising:

a main body having a front end portion and a rear end portion;

a tail fin boom having a first end connected to stabilizing fins, a second end connected to the rear end portion of the main body, and a central hole formed in the tail fin boom;

a rod shaped warhead disposed in the central hole and having a front end portion and a rear end portion provided with a non-circular cross-section rear-step; and restraining means for holding the warhead in a fixed position relative to the main body during flight and prior to impact comprising the rear-step of the warhead engaging a conforming surface on the tail fin boom to prevent spin-slipping movement of the warhead relative to the tail fin boom.

2. The anti-armor projectile of claim 1, further comprising:

a warhead a located in the main body, wherein the main body warhead is selected from the group of a chemical energy warhead (CE) and a multipurpose projectile (MP).

3. The anti-armor projectile of claim 2, wherein the restraining means further comprises a threaded connection of threads provided in the tail fin boom and a threaded screwing nut which engages the threads and the front end portion of the warhead for holding the warhead in the central hole to prevent axial movement of the warhead relative to the tail fin boom during flight.

4. The anti-armor projectile of claim 3, further comprising;

release means for releasing the warhead from the tail fin boom upon impact wherein the threaded connection comprises destructible threads in the tail fin boom and the threaded screwing nut that shear off upon impact to release the warhead from the tail fin boom.

5. The anti-armor projectile of claim 3, further comprising:

release means for releasing the warhead from the tail fin boom upon impact wherein the threaded connection comprises destructible threads in the tail fin boom and the threaded screwing nut that shear off upon impact to release the warhead from the tail fin boom.

6. The anti-armor projectile of claim 2, wherein the warhead comprises high-density material selected from the group of tungsten and depleted uranium.

7. The anti-armor projectile of claim 1, wherein the restraining means further comprises a threaded connection of threads provided in the tail fin boom and a threaded screwing nut which engages the threads and the front end portion of the warhead for holding the warhead in the central hole to prevent axial movement of the warhead relative to the tail fin boom during flight.

8. The anti-armor projectile of claim 7, further comprising;

release means for releasing the warhead from the tail fin boom upon impact wherein the threaded connection comprises destructible threads in the tail fin boom and the threaded screwing nut that shear off upon impact to release the warhead from the tail fin boom.

9. The anti-armor projectile of claim 1, wherein the warhead comprises high-density material selected from the group of tungsten and depleted uranium.

10. An anti-armor projectile comprising:

a main body having a front end portion and a rear end portion;

a tail fin boom having a first end connected to stabilizing fins, a second and connected to the rear end portion of the main body, and a central hole formed in the tail fin boom;

a rod shaped warhead having a front end portion, a rear end portion, and the warhead is disposed in the central hole of the tail fin boom; and restraining means for holding the warhead in a fixed position relative to the tail fin boom during flight and prior to impact, the restraining means comprising destructible threaded connection of restraining threads provided in the tail fin boom and a threaded screwing nut which engages the restraining threads and the front end portion of the warhead to hold the warhead in the central hole to prevent axial movement of the warhead relative to the tail fin boom during flight and upon impact the destructible threaded connection fails and the warhead is released from the tail fin boom.

11. The anti-armor projectile of claim 10, further comprising:

a warhead a located in the main body, wherein the main body warhead is selected from the group of a chemical energy warhead (CE) and a multipurpose projectile (MP).

12. An anti-armor projectile comprising:

a main body having a front end portion and a rear end portion, and a first warhead attached to the main body;

a tail fin boom having a front end connected to the rear end portion of the main body and a rear end connected to stabilizing fins, the tail fin boom having an inner hollow area closed at the front end and open at the rear end;

a second warhead comprising a kinetic energy penetrator disposed in the hollow area; and a restraining means connected to the tail fin boom and the second warhead for holding the second warhead in a fixed position during flight and for releasing the second warhead from the tail fin boom when the projectile impacts a target.

13. The anti-armor projectile of claim 12, wherein the warhead is selected from the group of a chemical energy warhead (CE) and a multipurpose projectile (MP).

14. An armor penetrating tandem projectile comprising:

a main body containing a warhead selected from the group of a chemical energy warhead (CE) and a multipurpose projectile (MP), and the main body a having front end portion and a rear end portion;

a tail fin boom having a first end connected to stabilizing fins, a second end connected to the rear end portion of the main body; and a long central hole formed in the tail fin boom;

a second warhead disposed in the central hole of the tail fin boom; and restraining means connected to the tail fin boom and the second warhead for holding the second warhead in a fixed position relative to the tail fin boom during flight and prior to impact.

15. The armor penetrating tandem projectile of claim 14, wherein the second warhead comprises a rod shaped, kinetic-energy penetrator.

16. The armor penetrating tandem projectile of claim 14, wherein the second warhead comprises an elongated kinetic energy penetrator selected from the group of tungsten and depleted uranium.

17. The armor penetrating tandem projectile of claim 14, further comprising a release means disposed in the tail fin boom to release the second warhead upon impact.

18. The armor penetrating tandem projectile of claim 14, wherein the second warhead comprises an elongated rod shaped penetrator and the restraining means comprises a rear-step non-circular cross section formed in a rear end of the penetrator which engages a conforming surface in the central hole of the tail fin boom to prevent spin-slipping movement of the penetrator relative to the tail fin boom.

19. The armor penetrating tandem projectile of claim 18 wherein the restraining means further comprises restraining threads provided in the central hole of the tail fin boom and a screwing nut means functioning to hold the warhead inside the central hole to prevent axial movement of the penetrator relative to the tail fin boom during flight.

20. The armor penetrating tandem projectile of claim 19, wherein the restraining threads and the screwing nut means fail upon impact to release the penetrator from the tail fin boom.

* * * * *